US008368585B2

(12) United States Patent
Kondo et al.

(10) Patent No.: US 8,368,585 B2
(45) Date of Patent: Feb. 5, 2013

(54) NAVIGATION ASSISTING DEVICE

(75) Inventors: Motoji Kondo, Nishinomiya (JP); Yoshihito Hayashi, Nishinomiya (JP); Takatsugu Kubo, Nishinomiya (JP)

(73) Assignee: Furuno Electric Company Limited, Nishinomiya (JP)

( * ) Notice: Subject to any disclaimer, the term of this patent is extended or adjusted under 35 U.S.C. 154(b) by 308 days.

(21) Appl. No.: 12/903,791

(22) Filed: Oct. 13, 2010

(65) Prior Publication Data

US 2011/0084870 A1 Apr. 14, 2011

(30) Foreign Application Priority Data

Oct. 14, 2009 (JP) ..... 2009-237398

(51) Int. Cl.
*G01S 13/66* (2006.01)
*G01S 13/93* (2006.01)

(52) U.S. Cl. ..... 342/41; 342/90; 342/95

(58) Field of Classification Search ..... 342/41, 342/90, 95–97, 107, 139, 195
See application file for complete search history.

(56) References Cited

U.S. PATENT DOCUMENTS

| | | | | |
|---|---|---|---|---|
| 7,016,772 | B2 * | 3/2006 | Yanagi | 701/21 |
| 7,089,094 | B2 * | 8/2006 | Yanagi | 701/21 |
| 2002/0161511 | A1 * | 10/2002 | Fujikawa et al. | 701/200 |
| 2006/0129288 | A1 * | 6/2006 | Yanagi | 701/21 |
| 2009/0079590 | A1 * | 3/2009 | Hiraoka | 340/984 |
| 2010/0153013 | A1 * | 6/2010 | Kondo et al. | 701/301 |
| 2011/0084870 | A1 * | 4/2011 | Kondo et al. | 342/41 |
| 2011/0109492 | A1 * | 5/2011 | Nakahama | 342/89 |
| 2012/0101668 | A1 * | 4/2012 | Ioroi et al. | 701/21 |

FOREIGN PATENT DOCUMENTS

| | | | | |
|---|---|---|---|---|
| EP | 1 298 453 | A2 | | 4/2003 |
| GB | 2 382 250 | A | | 5/2003 |
| GB | 2385224 | A | * | 8/2003 |
| JP | 2001-338400 | A | | 12/2001 |
| JP | 2003175889 | A | * | 6/2003 |
| JP | 3995462 | B2 | | 10/2007 |
| JP | 2008-281504 | A | | 11/2008 |
| JP | 2009-204307 | A | | 9/2009 |

* cited by examiner

*Primary Examiner* — John B Sotomayor
(74) *Attorney, Agent, or Firm* — Birch, Stewart, Kolasch & Birch, LLP

(57) ABSTRACT

This disclosure provides a navigation assisting device, which includes a TT information acquiring module for acquiring target object data by performing target tracking based on an echo received by a radar antenna, an AIS information acquiring module for acquiring target object data based on a Universal Shipborne Automatic Identification System, a maximum-number-of-output-data determination module for determining a maximum number of output data that is the number of target object data that is outputable while the radar antenna revolves once, a priority determination module for performing a priority determination according to a predetermined rule, for the target object data acquired by the TT information acquiring module and the target object data acquired by the AIS information acquiring module, and an output control module for outputting the target object data fewer than the maximum number of output data according to the priorities while the radar antenna revolves once.

14 Claims, 4 Drawing Sheets

NAVIGATION ASSISTING DEVICE

CROSS-REFERENCE TO RELATED APPLICATION(S)

The application claims priority under 35 U.S.C. §119 to Japanese Patent Application No. 2009-237398, which was filed on Oct. 14, 2009, the entire disclosure of which is hereby incorporated by reference.

TECHNICAL FIELD

The present invention relates to a navigation assisting device for acquiring information on a target object(s) around a ship and outputting the information on the target object(s) to the outside of the device.

BACKGROUND

Lately, various kinds of navigation assisting devices have been developed in terms of collision prevention and human life safety of ships. As such a navigation assisting device, a radar apparatus provided with a TT (Target Tracking) function is known, for example. The TT function is to detect positions and velocity vectors of the target objects which exist around a ship concerned based on a transition of radar images of the past, and inform of the target objects with risks, etc. The TT function is conventionally referred to as an "ARPA (Automatic Radar Plotting Aid)."

Conventionally, the radar apparatus provided with the TT function as described above may be configured to output the data indicating the position, speed, course and the like of the target object detected by the TT function (hereinafter, may be referred to as "target object data") to the outside of the apparatus. Because the target object data is updated every moment, it is preferred that new target object data can be outputted each time without any delay if it is configured so that the target object data is outputted to the outside of the apparatus.

For the output of the target object data to the outside as described above, the international standard defines a serial output which is carried out at a predetermined communication rate. The communication rate defined by the international standard may not be fast enough, and if many target objects are detected by the TT, there is a problem that it takes a lot of time to finish the output of all the target object data. Thus, if the output of the target object data takes time, a delay will occur to output the subsequent new target object data.

However, because the TT processes the radar image to detect the target object, it has a limitation in the number of detectable target objects due to a high load of the processing operation. Therefore, although the delay of the data output occurs if there are many target objects, this does not directly mean that a large delay to cause practical problems has occurred.

In the meantime, AISs (Universal Shipborne Automatic Identification Systems) have become common in recent years, and radar apparatuses which can use both the information of the AIS and the information acquired by the TT function have appeared in the market. The AIS is a system for transmitting positional information, traveling information and the like on a ship concerned to the circumference by wireless communications at a predetermined cycle according to the status of the ship (mooring, traveling, etc.), and it can acquire information on the positions, speeds and the like of other ships by receiving the positional information, traveling information and the like from the other ships (the target object data, described above).

The radar apparatus which can use both the information of the AIS and the TT (ARPA) is disclosed in JP 2008-281504 (A), for example. Further, the processing of the received AIS information is disclosed in JP 3,995,462, for example.

Because the radar apparatuses which can deal with the multiple information of the AIS and the TT as described above have been developed, it is desired that the target object data based on the AIS is also outputted to the outside of the radar apparatus, in addition to the target object data based on the TT.

In the meantime, because the AIS acquires all the target object data transmitted from other ships as long as they are receivable, the radar apparatus side which received the outputs must treat a more amount of the target object data comparing with the TT. For this reason, in the radar apparatus which can use the information of both the AIS and the TT, the total number of the target object data to treat may increase significantly. In this case, if the apparatus is configured to output all the target object data to the outside, the data amount to be outputted increases in proportion to the number of the target objects. Therefore, the output cycle of the target object data will be very long, and a large delay to the data update occurs on the side of an instrument which receives the target object data, resulting in a practical problem.

SUMMARY

The present invention is made in view of the above situations, and provides a navigation assisting device for outputting target object data appropriately, under a limited serial communication rate.

According to an aspect of the invention, a navigation assisting device is provided, which includes a TT information acquiring module for acquiring target object data by performing target tracking based on an echo received by a radar antenna, an AIS information acquiring module for acquiring target object data based on a Universal Shipborne Automatic Identification System, a maximum-number-of-output-data determination module for determining a maximum number of output data that is the number of target object data that is outputable while the radar antenna revolves once, a priority determination module for performing a priority determination according to a predetermined rule, for the target object data acquired by the TT information acquiring module and the target object data acquired by the AIS information acquiring module, and an output control module for outputting the target object data fewer than the maximum number of output data according to the priorities while the radar antenna revolves once.

That is, in the navigation assisting device for acquiring the target object data in each of the AIS and the TT, because the number of target object data increases, the data output tends to be delayed. In this regard, as described above, the number of target object data being outputted is reduced to below the maximum number of output data, thereby the delay of the data output can be prevented. In addition, the data output can be carried out while suppressing the delay, where the target object data acquired by the TT information acquiring module and the target object data acquired by the AIS information acquiring module are mixed together.

The maximum-number-of-output-data determination module may measure a revolving speed of the radar antenna, and calculate the maximum number of output data based on the revolving speed.

According to another aspect of the invention, a navigation assisting device is provided, which includes a TT information acquiring module for acquiring target object data by performing target tracking based on an echo received by a radar antenna, an AIS information acquiring module for acquiring target object data based on a Universal Shipborne Automatic Identification System, a priority determination module for performing a priority determination according to a predetermined rule, for the target object data acquired by the TT information acquiring module and the target object data acquired by the AIS information acquiring module, and an output control module for outputting the target object data. The output control module outputs the target object data sequentially from the target object data with the highest priority, until a rotation angle of the radar antenna reaches a second predetermined angle from a first predetermined angle.

That is, in the navigation assisting device for acquiring the target object data in each of the AIS and the TT, because the number of target object data increases, the data output tends to be delayed. In this regard, as described above, the target object data can be outputted at the revolving cycle of the radar antenna by configuring. In addition, the data output can be carried out while suppressing the delay, where the target object data acquired by the TT information acquiring module and the target object data acquired by the AIS information acquiring module are mixed together.

The priority determination module may calculate at least one index, for each of the target object data acquired by the TT information acquiring module and the target object acquired by the AIS information acquiring module, the index related to a distance to a target object corresponding to the target object data, a speed of the target object, CPA, TCPA, BCR and BCT, and perform the priority determination based on the index.

The target object data acquired by the TT information acquiring module may be outputted with a higher priority.

The priority determination module may update the priorities for every predetermined priority updating cycle.

The priority updating cycle may be longer than the revolving cycle of the radar antenna.

BRIEF DESCRIPTION OF THE DRAWINGS

The present disclosure is illustrated by way of example and not by way of limitation in the figures of the accompanying drawings, in which the like reference numerals indicate like elements and in which.

DESCRIPTION OF EMBODIMENT

Several embodiments of the present invention will be described with reference to the appended drawings.

First Embodiment

Figure 1:
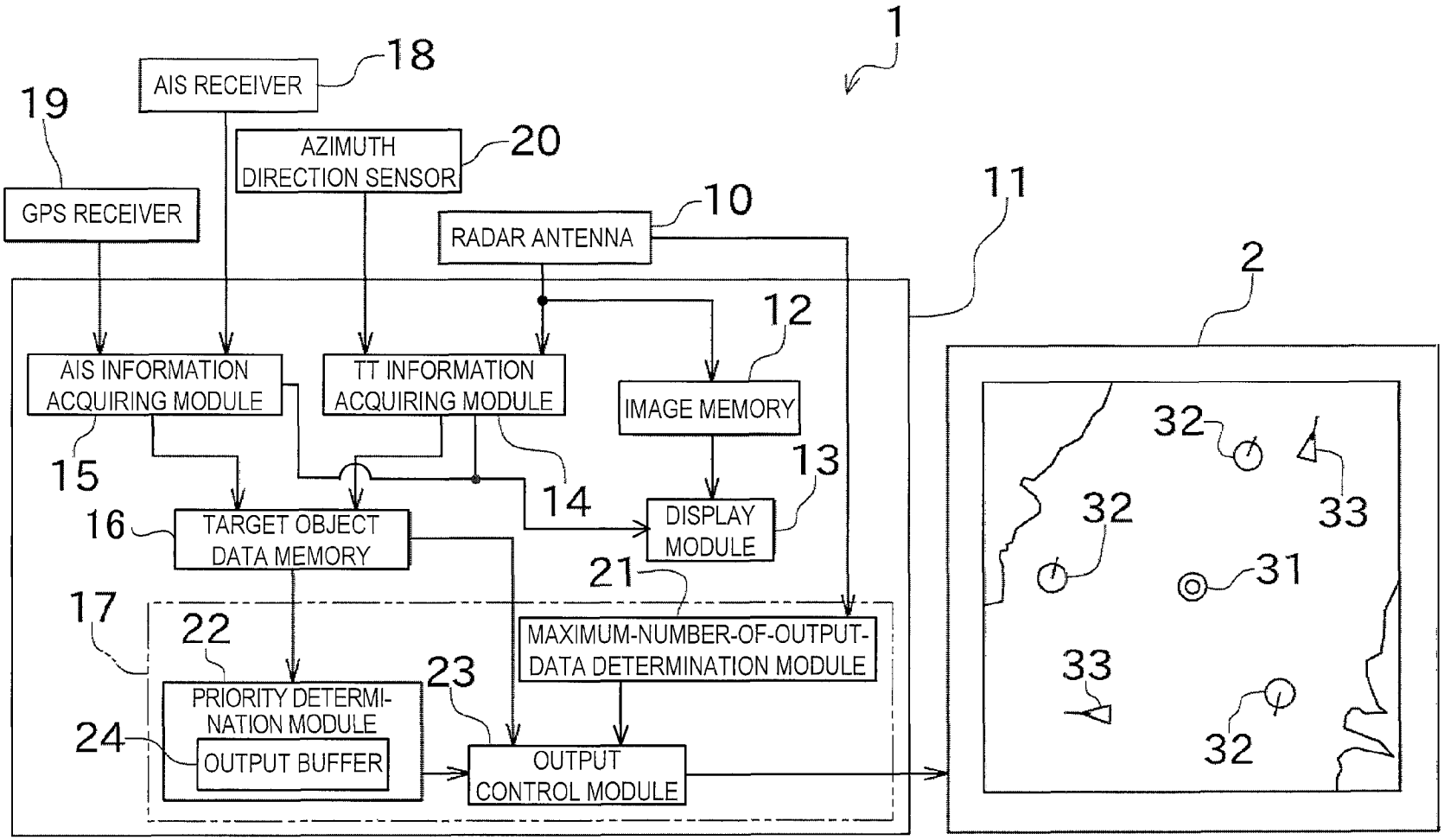
FIG. 1 is a block diagram mainly showing a configuration of a radar apparatus for a ship according to an embodiment of the present invention.

FIG. 1 is a block diagram mainly showing a configuration of a radar apparatus 1 for a ship according to a first embodiment of the present invention.

As shown in FIG. 1, the radar apparatus 1 of this embodiment includes a radar antenna 10 and a radar instruction module 11 (navigation assisting device).

In this embodiment, the radar apparatus 1 is configured as a known pulse radar apparatus. That is, the radar antenna 10 transmits a pulse-shaped electric wave having a strong directivity, and receives an echo (reflection wave) which is obtained by the pulse-shaped electric wave being reflected on a target object and returned to the radar antenna 10. The radar antenna 10 performs transmission and reception of the electric wave repeatedly, while rotating in a horizontal plane at a predetermined revolving speed. With the above configuration, scanning can be carried out in the horizontal plane for 360° centering on the ship (hereinafter, the ship that equips the radar apparatus 1 is referred to as "the ship" or "the ship concerned").

The revolving speed of the radar antenna 10 can be changed by a selection of an operator. In this embodiment, the revolving speed of the radar antenna 10 can be switched between a low speed (24 rpm) and a high speed (40 rpm).

The signal received by the radar antenna 10 is applied with an A/D conversion and the like in a reception circuit (not illustrated) to be converted into digital reception data, and is then inputted to the radar instruction module 11.

The radar instruction module 11 includes an image memory 12, a display module 13, a TT information acquiring module 14, an AIS information acquiring module 15, a target object data memory 16, and an external output module 17. The TT information acquiring module 14, the AIS information acquiring module 15, the external output module 17 and the like are configured as dedicated hardware having a micro controller. The reception data is inputted to the image memory 12 and the TT information acquiring module 14.

The image memory 12 stores the reception data outputted during one revolution of the radar antenna 10. Because the reception data for one revolution of the radar antenna 10 is data which are scanned in the horizontal plane for 360° centering on the ship concerned, two-dimensional image (radar image) indicating the situation of the target object(s) around the ship concerned is stored in the image memory 12.

The display module 13 is a liquid crystal display in this embodiment where a color indication is possible, and it reads out and displays the radar image stored in the image memory 12. Thereby, the operator can check the situation around the ship concerned based on the radar echoes by the display module 13.

The TT information acquiring module 14 is to implement a TT (target tracking) function. Because this TT (or ARPA) function is known, detailed description thereof is omitted. However, a velocity vector is presumed by automatically detecting and acquiring a position of the target object based on the radar image, and tracking a movement of the target object based on a transition of the radar image with time. Note that, because the information about the position of the target object obtained by the TT is relative information with respect to the ship concerned, a relative azimuth direction of each target object can be acquired, but an absolute azimuth direction of each target object seen from the ship concerned (azimuth direction information based on the earth) cannot be acquired. For this reason, in this embodiment, the signal from an azimuth direction sensor 20 is inputted to the TT information acquiring module 14, and the azimuth direction information based on the earth can be acquired based on the signal. Thereby, the information, such as the position of the target object (a distance from the ship concerned and a direction seen from the ship concerned), the relative speed, the course and the like of the target object with respect to the ship concerned (target object data) can be acquired based on the echo signal received by the radar antenna 10. In addition, a motion (speed and course) of the target object based on the earth can be obtained by taking the movement of the ship concerned into consideration.

An AIS receiver 18 and a GPS receiver 19 are connected with the radar apparatus 1, and signals from the AIS receiver 18 and the GPS receiver 19 are inputted to the AIS information acquiring module 15. With this configuration, the AIS signals transmitted from other ships can be received. Because the AIS is known, detailed description thereof is omitted. The AIS signal includes information, such as the position, speed, and course of the ship concerned. The AIS information acquiring module 15 acquires at least the position of the ship concerned (hereinafter, may be referred to as "the ship position") based on the signal received by the GPS receiver 19. Then, the AIS information acquiring module 15 acquires the target object data, such as a position of the other ship (a distance from the ship concerned and a direction seen from the ship concerned), as well as a ship speed, a course and the like of the other ship, based on the received AIS signal and the position of the ship concerned calculated from the GPS signal.

The target object data acquired by the TT information acquiring module 14 and the AIS information acquiring module 15 are stored in the target object data memory 16. In this embodiment, the target object data memory 16 is a RAM that can store a lot of the acquired target object data. When the TT information acquiring module 14 or the AIS information acquiring module 15 detects a new target object, target object data indicating the target object is newly registered onto the target object data memory 16. On the other hand, for the target object for which the target object data has already registered onto the target object data memory 16, whenever new target object data is obtained for the target object, the content stored in the target object data memory 16 is updated.

The target object data acquired by the TT information acquiring module 14 and the AIS information acquiring module 15 are outputted to the display module 13 to be displayed intelligibly. For example, in the display module 13, a mark indicating a position and a moving direction of the detected target object is displayed on the display module 13 so as to be superimposed on the radar image. Thereby, the operator of the radar apparatus 1 can check on the display module 13 the information on the position, moving direction and the like of the target object acquired based on the TT or the AIS.

Although the AIS can securely acquire accurate target object data of other ships, information on a ship which does not carry the AIS cannot be acquired. On the other hand, the TT can acquire target object data even for a target object which does not carry the AIS; however, it may not be able to correctly track the target object if there are much noises and clutters on a radar image. As described above, because there are advantages and disadvantages in acquisition of the target object data based on the AIS and the acquisition of the target object data based on the TT, respectively, the navigational safety can be improved by using both the methods together.

Next, an updating cycle of the target object data is described.

The TT information acquiring module 14 can detect a new position of the target object every time the radar image is updated (every time the radar antenna 10 revolves once). That is, new target object data can be acquired at the revolving cycle of the radar antenna 10. As described above, because the revolving speed of the radar antenna 10 is ranging from 24 rpm (a cycle of 2.5 seconds) to 40 rpm (a cycle of 1.5 seconds), the TT information acquiring module 14 can obtain new target object data every 2.5 seconds to 1.5 seconds. In this embodiment, the TT information acquiring module 14 can track 100 target objects at the maximum (that is, 100 target object data can be acquired at the maximum while the radar antenna 10 revolves once).

On the other hand, a transmission cycle of the AIS signal changes a cycle of 2 seconds to 3 minutes according to the ship's traveling state. Therefore, if one sees from the side of receiving the AIS signal (the AIS information acquiring module 15 side), the cycle at which the AIS signal can be received is irregular and, moreover, the cycle differs for each target object. Therefore, the receiving cycle of the AIS signal is not necessarily in agreement with the cycle at which new target object data can be acquired by the TT information acquiring module 14 (the revolving cycle of the radar antenna 10). However, according to the latest IEC standard, calculating a predicted position based on a velocity vector at a cycle equivalent to the revolving cycle of the radar antenna 10 is required.

For this reason, in this embodiment, the AIS information acquiring module 15 is configured to calculate the predicted position of another ship at the revolving cycle of the radar antenna 10 based on the velocity vector information on the other ship extracted from the AIS signal received in the past. Thereby, substantially, the predicted position of the target object data based on the AIS can be acquired for every revolution of the radar antenna 10 (for every 2.5 seconds to 1.5 seconds). Thus, the AIS information acquiring module 15 and the TT information acquiring module 14 can update the target object data at the same cycle. In this embodiment, the AIS information acquiring module 15 can treat 1000 target object data at the maximum.

Therefore, in this embodiment, the new target object data corresponding to 1100 target objects can be acquired at the maximum for every revolution of the radar antenna 10 (every 2.5 seconds to 1.5 seconds).

Next, a configuration of the external output module 17 for outputting the target object data acquired as described above to an external apparatus is described. In this embodiment, an ECDIS 2 is assumed to be the external apparatus.

The ECDIS (Electronic Chart Display and Information System) is a system for acquiring the ship position by the GPS and automatically displaying a nautical chart around the ship concerned on the display module based on the electronic chart information prepared in advance.

The ECDIS 2 displays various kinds of additional information on the display module in addition to the chart information, assists the ship operator in route planning and cruise surveillance. As the additional information, there is information on the target object data based on the TT and the AIS outputted from the radar apparatus 1. An example in which such information is displayed on the display module so as to be superimposed on the chart information is schematically shown in FIG. 1. As shown in FIG. 1, target object marks 32 based on the TT information and target object marks 33 based on the AIS information are displayed around a ship mark 31 indicating the position of the ship concerned. The target object marks 32 and 33 indicate the positions and the moving directions of the target objects calculated based on the TT and the AIS, respectively. By configuring in this way, the operator of the ECDIS can check, on the display module, positions and the like of other ships traveling near the ship concerned, along with the chart information.

In the meantime, the IEC standard which is an international standard defines that, when outputting the target object data from the radar apparatus, a serial output must be carried out at a communication rate of 4800 bps or 38400 bps. Therefore, in this embodiment, the external output module 17 can switch the communication rate at the time of data output between 4800 bps and 38400 bps. The selection of the communication rate is determined according to the communication rate supported by the external apparatus (in this embodiment, the ECDIS 2) which is a destination of the output. If the external apparatus supports both the communication rates, the faster communication rate (38400 bps) may be used.

A communication sentence called "TTD (Tracked Target Data structure) is defined by the IEC62388 which is the latest standard, as a data format when outputting the target object data from the radar apparatus. The TTD transmits the target object data calculated based on the MS or the TT (the distance from the ship concerned to the target object, the direction of the target object seen from the ship concerned, the speed of the target object, the course of the target object, etc.) in a binary format, and can transmit the target object data for the maximum of four target objects by one sentence. In the TTD, a data length is fixed and one sentence has 82 bytes. Because 10 bits (start bit [1 bit]+data [8 bits]+stop bit [1 bit]) are required to transmit 1 byte of data, one sentence of the TTD can be transmitted by 820 bits.

Here, as described above, the radar apparatus 1 of this embodiment can treat the target object data of 1100 points at the maximum. Therefore, if the maximum number of the target object data is outputted by the TTD (it can transmit four target object data by one sentence), it requires at least, 1100/4=275 sentences. If this is outputted at 38400 bps, $$820 \text{ bits} \times 275/38400 \text{ bps} = 5.9 \text{ s.}$$

That is, if the maximum number of the target object data is outputted, it takes about 6 seconds at the maximum. If outputting at 4800 bps, $$820 \text{ bits} \times 275/4800 \text{ bps} = 47 \text{ s.}$$

That is, if the maximum number of the target object data is outputted at this communication rate, it takes about 47 seconds at the maximum.

On the other hand, as described above, in this embodiment, new target object data can be acquired for every revolution of the radar antenna 10 (every 2.5 seconds to 1.5 seconds). Therefore, by outputting the target object data while taking 6 seconds or 47 seconds, a delay occurs by the time the TTD outputs the new target object data, thereby causing a practical problem.

For this reason, the external output module 17 with which the radar apparatus 1 of this embodiment equips is configured as follows, in order to enable appropriate outputs of the target object data with the limited serial communication rate. That is, the external output module 17 includes a maximum-number-of-output-data determination module 21, a priority determination module 22, and an output control module 23.

First, the maximum-number-of-output-data determination module 21 is described.

The maximum-number-of-output-data determination module 21 calculates the maximum number of target object data (the maximum number of output data) which can be outputted while the radar antenna 10 revolves once. If the TTD is used (four target object data can be outputted by 820 bits), the maximum number of output data can be obtained by the following formula.

$$(\text{Communication rate [bps]} \times \text{radar antenna revolving cycle [s]}/820 \text{ [bit]}) \times 4 \quad (1)$$

Based on the above formula (1), if the communication rate is 4800 bps or 38400 bps, and if the radar antenna revolving cycle is 2.5 seconds or 1.5 seconds, the result of calculation of the maximum number of output data is shown in Table 1, respectively.

TABLE 1

| Communication Rate | Antenna Revolving Cycle = 2.5 sec (24 rpm) | Antenna Revolving Cycle = 1.5 sec (40 rpm) |
|---|---|---|
| 4800 bps | 58 target objects | 35 target objects |
| 38400 bps | 468 target objects | 281 target objects |

As described above, the revolving cycle of the radar antenna 10 is made to be either one of 2.5 seconds and 1.5 seconds in this embodiment. However, it is difficult to keep the revolving cycle exactly constant because an individual difference, a voltage variation and the like exist in the radar antenna 10 in fact. For this reason, in this embodiment, the maximum-number-of-output-data determination module 21 measures the revolving cycle of the radar antenna 10, and based on the measured revolving cycle, it calculates the maximum number of output data for every measurement. Thereby, it can calculate the maximum number of output data more accurately.

The maximum number of output data calculated by the maximum-number-of-output-data determination module 21 is transmitted to the output control module 23. The output control module 23 limits the number of target object data outputted to the ECDIS 2 during one revolution of the radar antenna 10 to the maximum number of output data. Thereby, a situation where the output of the target object data is not completed even if the radar antenna 10 finishes revolving once can be prevented. That is, it can prevent that the output of data is delayed with respect to the updating cycle of the target object data (the revolving cycle of the radar antenna 10).

Next, the priority determination module 22 is described.

As described above, the output control module 23 performs the control in which the number of target object data outputted to the ECDIS 2 during one revolution of the radar antenna 10 is limited to the maximum number of output data (in other words, the number of target object data which the output control module 23 can output is limited). Therefore, it is desired that the target object data to be outputted is selected and the target object data of operator's interest is outputted on a priority basis. For this reason, the priority determination module 22 determines priorities of the target object data acquired by the TT information acquiring module 14 and the AIS information acquiring module 15, where the priorities are for outputting the target object data to the ECDIS 2.

Various rules at the time of performing the priority determination can be considered. If a high priority can be determined for the target object data with a high operator's interest level, it is suitable because the output of the target object data which the operator should observe can be secured. Therefore, as the rule of the priority determination, an order of distance, speed, CPA, TCPA, BCR, BCT or the like may be appropriate. It is because that the target object located closer in distance from the ship concerned and the target object moving fast are considered to have high operator's interest levels. Similarly, the target object with a smaller value of CPA, TCPA, BCR, BCT or the like is considered to have a high operator's interest level.

Figure 2A:
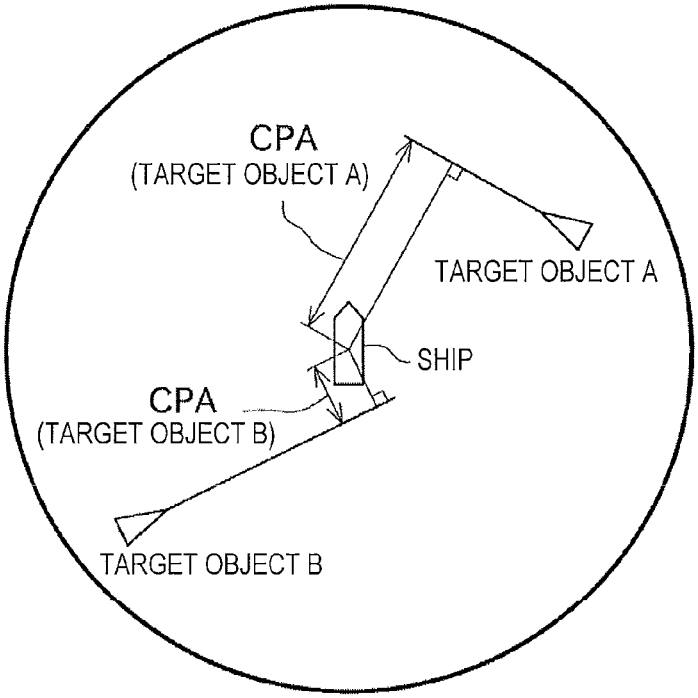
FIG. 2A is a relative vector diagram for illustrating how to calculate a CPA.

The CPA is an abbreviation for "Closest Point of Approach," and indicates a distance between the ship concerned and the target object when they reach the closest distance. The CPA can be easily calculated if a relative velocity vector of the target object with respect to the ship concerned is known. A method of calculating the CPA between the ship concerned and the moving target object is shown in the relative vector diagram of FIG. 2A. The TCPA is an abbreviation for "Time to CPA," and indicates a time to the closest approach of the ship concerned and the target object.

Figure 2B:
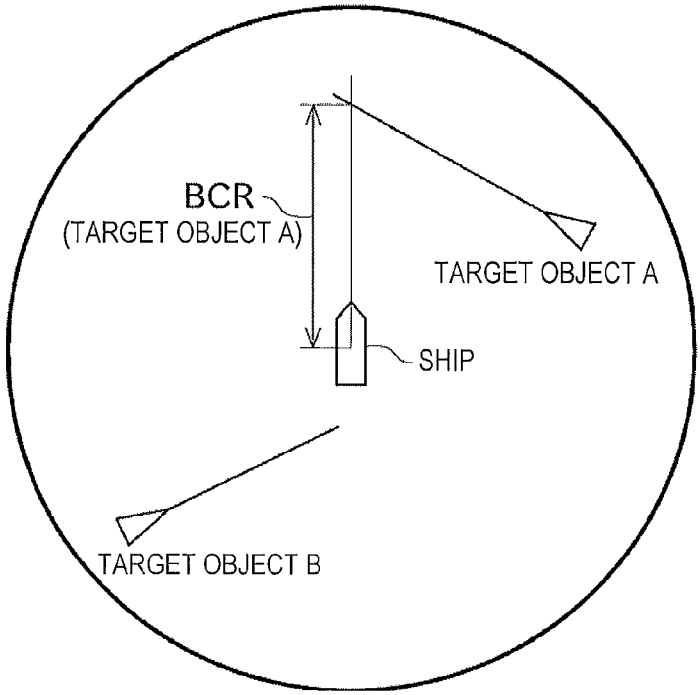
FIG. 2B is a relative vector diagram for illustrating how to calculate a BCR.

The BCR is an abbreviation for "Bow Crossing Range," and indicates a distance between the ship concerned and the target object when the target object crosses the bow direction of the ship concerned. The BCR can be easily calculated if the relative velocity vector of the target object with respect to the ship concerned is known. A method of calculating the BCR between the ship concerned and the moving target object is shown in the relative vector diagram of FIG. 2B. Note that, if the BCR is calculated for a target object (a target object B in FIG. 2B) which is crossing the stern direction of the ship concerned, it will be a negative value. Thus, it is considered that the target object which is crossing the stern direction has a low operator's interest level compared with the target object which is crossing the bow direction (the target object which comes out in front of the ship concerned, i.e., a target object A in FIG. 2B). Then, it may be configured so that the target object data with the negative BCR has a low priority level in the priority determination. The BCT is an abbreviation for "Bow Crossing Time," and indicates a time at which the target object crosses the bow direction of the ship concerned.

The operator can selectively use the order of distance, speed, CPA, TCPA, BCR, or BCT as the rule of priority determination according to his/her preferences. As an example among these, a case where the priority determination is performed in the order of distance from the ship concerned to each target object is described. In this case, it is considered that the target object located closer to the ship concerned has a higher operator's interest level. First, the priority determination module 22 reads the target object data from the target object data memory 16 sequentially, and calculates the distance between the target object and the ship concerned which is indicated by the target object data, for each target object data.

Then, the priority determination module 22 rearranges (sorts) the target object data so that the target object data indicating the target object closest to the ship concerned comes first, and stores the sorted target object data series in an output buffer 24. This situation is shown in the schematic diagram of FIG. 3. By this, it means that the priority determination according to the distances from the ship concerned to respective target objects have been performed for the target object data corresponding to the target objects. Note that the target object data memory 16 stores both the target object data from the TT information acquiring module 14 and the target object data from the AIS information acquiring module 15. Therefore, by performing the above processing, the priority determination can be performed where two kinds of the target object data are mixed (the target object data based on the TT and the target object data based on the AIS).

Figure 3:
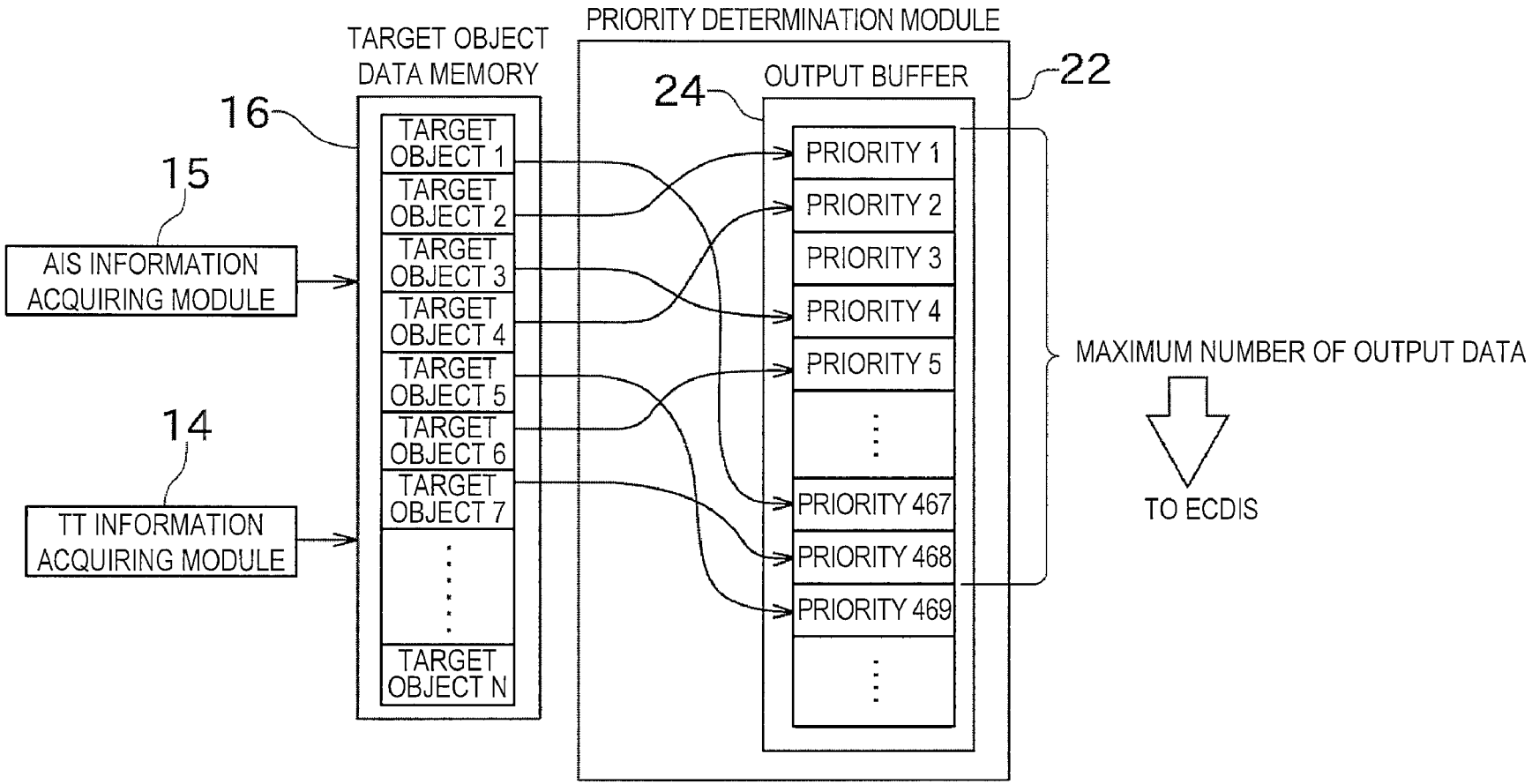
FIG. 3 is a schematic diagram for illustrating sorting of the target object data.

The output control module 23 reads out the target object data sequentially from the head of the output buffer 24 (from the data with a higher priority) while the radar antenna 10 revolves once, and then outputs the target object data up to the maximum number of output data to the ECDIS 2 (refer to the schematic diagram in FIG. 3). With the above configuration, the number of target object data which can be outputted is limited to the maximum number of output data, and the target object data with a higher operator's interest level can be outputted with a higher priority.

Then, the output control module 23 repeats at the revolving cycle of the radar antenna 10 the above-mentioned operation in which the target object data up to the maximum number of output data counted from the head of the output buffer 24 are outputted. Thereby, because the output cycle of the target object data can be in agreement with the updating cycle of the target object data (the revolving cycle of the radar antenna 10), new target object data can be outputted to the ECDIS 2 without any delay.

Note that, because the distance between the ship concerned and the target object varies every moment, the priority determination module 22 is necessary to recalculate the distance from the ship concerned to each target object based on latest information (of course, even when the target object data are sorted by other indices, such as the order of speed, CPA, TCPA, BCR, and BCT, it is necessary to recalculate these indices based on the latest information). However, if the sort by the priorities is carried out frequently, the priority order changes frequently, and, as a result, the target objects for which the target object data are outputted from the output control module 23 and the target objects for which the target object data are not outputted will be interchanged frequently. Then, the target object marks 32 and 33 may or may not be displayed on the ECDIS 2. Therefore, it may not be suitable for practical use because the operator will get confused.

Therefore, in this embodiment, the recalculation of the distance from the ship concerned to each target object is carried out at a cycle longer than the revolving cycle of the radar antenna 10 (for example, 1 minute). Thus, the priorities of the target object data are updated at a cycle longer than the revolving cycle of the radar antenna 10 (priority updating cycle). Because the priorities of the target objects can be maintained by this while the radar antenna 10 revolves several times, it can prevent that the target objects for which the data are outputted and the target objects for which the data are not outputted are interchanged frequently, thereby more practical data can be outputted.

As described above, in this embodiment, the radar apparatus 1 includes the TT information acquiring module 14, the AIS information acquiring module 15, the maximum-number-of-output-data determination module 21, the priority determination module 22, and the output control module 23. The TT information acquiring module 14 acquires the target object data by performing the target tracking based on the echo received by the radar antenna 10. The AIS information acquiring module 15 acquires the target object data based on the AIS. The maximum-number-of-output-data determination module 21 determines the maximum number of output data which is the number of target object data which can be outputted while the radar antenna 10 revolves once. The priority determination module 22 performs the priority determination according to the predetermined rule for the target object data acquired by the TT information acquiring module 14 and the target object data acquired by the AIS information acquiring module 15. The output control module 23 outputs the target object data fewer than the maximum number of output data according to the priorities while the radar antenna 10 revolves once.

That is, in the radar apparatus where the target object data is acquired by each of the AIS and the TT, because the number of target object data increases, the data output tends to be delayed. In this regard, as described above, the number of target object data which are outputted is maintained below the maximum number of output data, thereby the delay of the data output can be prevented. In addition, the data output can be carried out while suppressing the delay, where the target object data acquired by the TT information acquiring module 14 and the target object data acquired by the AIS information acquiring module 15 are mixed together.

In this embodiment, the maximum-number-of-output-data determination module 21 of the radar apparatus 1 measures the revolving speed (revolving cycle) of the radar antenna 10, and then calculates the maximum number of output data based on the revolving speed.

Thereby, even if the revolving speed of the radar antenna 10 varies, the number of target object data which can be outputted during one revolution of the radar antenna 10 can be calculated appropriately.

In this embodiment, the radar apparatus 1 is configured as follows. That is, the priority determination module 22 calculates any one of indices including the distance to the target object, the speed of the target object, the CPA, TCPA, BCR, and BCT which are indicated by the target object data, for each of the target object data acquired by the TT information acquiring module 14 and the target object data acquired by the AIS information acquiring module, and then, performs the priority determination based on the calculated index.

That is, because the number of target object data which can be outputted while the radar antenna 10 revolves once is limited, it is preferred that the target object data with a high operator's interest level is outputted with a higher priority. In this regard, it can be determined that, for example, the target object which is close in distance, moving fast and the like is a target object to be observed by the operator with interest. Therefore, by determining the priorities of the output based on these indices for respective target object data, the target object data can be outputted from the one with a higher operator's interest level first.

In the radar apparatus 1 of this embodiment, the priority determination module 22 updates the priorities for every predetermined priority updating cycle.

In other words, although the position, the speed and the like of the target object vary every moment, the target object data can be appropriately outputted with the priorities according to the situation by suitably updating the priorities of the target object data as described above.

In the radar apparatus 1 of this embodiment, the priority updating cycle is longer than the revolving cycle of the radar antenna 10.

Thereby, the priorities of the target objects can be maintained while outputting the target object data for two or more times. For example, when the priorities of the target objects are updated for every revolution of the radar antenna 10, the target object for which the data is outputted and the target object for which the data is not outputted are interchanged frequently for every revolution of the radar antenna 10. In this regard, by configuring as described above, it can prevent that the target object for which the data is outputted and the target object for which the data is not outputted are frequently interchanged, thereby more practical data can be outputted.

Figure 4:
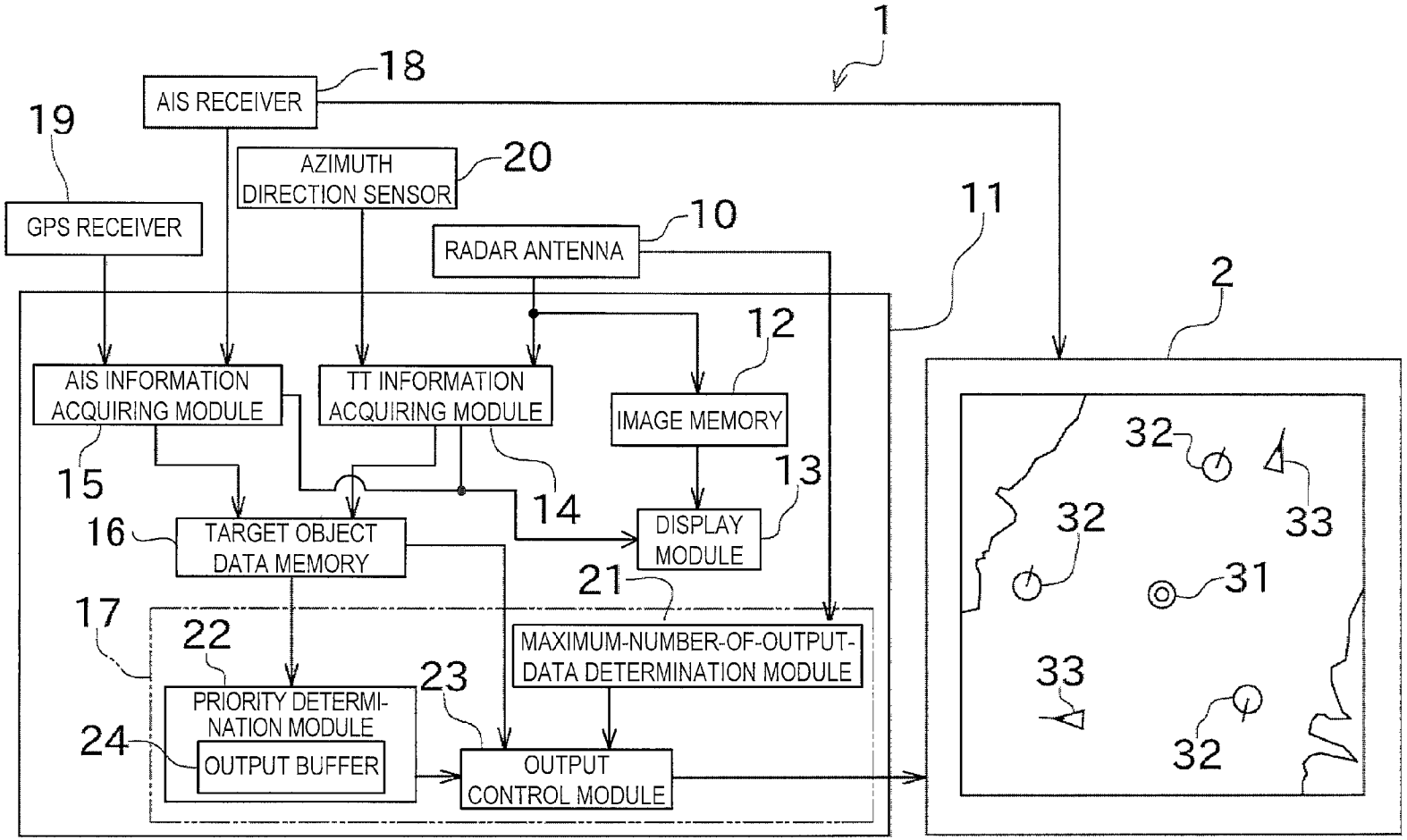
FIG. 4 is a block diagram mainly showing a configuration of a radar apparatus for the ship according to a modification to the embodiment.

Next, a modification of the above embodiment is described with reference to FIG. 4. In the following description, configurations identical or similar to the above embodiment are denoted with the same reference numerals as the above embodiment, and description thereof is omitted.

In this modification, the AIS receiver 18 is connected with the radar apparatus 1 and the ECDIS 2. The ECDIS 2 can acquire the target object data based on the AIS information. Therefore, the ECDIS 2 side is not necessary to acquire the target object data based on the AIS information from the radar apparatus 1. On the other hand, because the target object data based on the TT is information which cannot be acquired unless it is on the side of the radar apparatus 1, the data needs to be inputted from the radar apparatus 1 to the ECDIS 2.

In order to support such a situation, the radar apparatus 1 of this modification can selectively switch between the method of outputting the target object data based on the TT and the target object data based on the MS so as to mix them (the configuration of the above embodiment), and the method of outputting the target object data based on the TT with a higher priority, according to a setting by the operator. Therefore, like this modification, if the AIS information can be acquired by the ECDIS 2, the information needed on the side of the ECDIS 2 can be outputted with a higher priority by switching to the method of outputting the target object data based on the TT with a higher priority.

As described above, in this modification, the radar apparatus 1 can output the target object data acquired by the TT information acquiring module 14 with a higher priority.

That is, the target object data based on the TT is the information which is acquired after the processing such as the target tracking by the TT information acquiring module 14, and is the information which can be acquired only by the radar apparatus 1. On the other hand, because the data which are outputted serially by the AIS receiver are used as the target object data based on the AIS, the data is information which can be used by any apparatuses other than the radar apparatus. Therefore, compared with the target object data acquired by the AIS information acquiring module 15, the target object data acquired by the TT information acquiring module 14 may be more valuable as information. In this regard, by configuring as described above, the useful information can be outputted on the priority basis.

Second Embodiment

Next, a second embodiment of the present invention is described. Note that, in the following description, configurations identical or similar to those of the first embodiment are denoted with the same numerals, and description thereof is omitted.

In this embodiment, instead of determining the maximum number of output data in advance, a rotation angle of the radar antenna 10 is detected by the output control module 23 to prevent the output cycle of the target object data from being delayed with respect to the revolving cycle of the radar antenna 10. Note that, because the radar apparatus 1 of this embodiment does not have to calculate the maximum number of output data, the maximum-number-of-output-data determination module 21 provided to the radar apparatus of the first embodiment can be omitted.

Specifically, when the output control module 23 detects that the rotation angle of the radar antenna 10 reaches a first predetermined angle (for example, 0 degree), it starts the output of the target object data. At this time, the output control module 23 outputs the target object data to the ECDIS 2 sequentially, starting from the target object data with the highest priority. The radar antenna 10 continues its rotation while the output control module 23 is sequentially outputting the target object data, and the rotation reaches in due course a second angle (for example, 350°) just before one revolution (360° rotation from the first angle) is completed. When the output control module 23 detects that the rotation angle of the radar antenna 10 reached the second angle, it stops the output of the target object data.

Then, if the radar antenna 10 rotates more and the rotation angle reaches again the first predetermined angle (0°) the output control module 23 again outputs the target object data to the ECDIS 2 sequentially, starting from the target object data with the highest priority. That is, every time the radar antenna 10 revolves once, it resumes the output of the target object data, starting from the target object data with the highest priority.

By configuring as described above, without calculating the maximum number of output data in advance, the target object data with higher operator's interest levels can be outputted while the radar antenna revolves once. Further, in this embodiment, the output operation of the target object data is started every time the rotation angle of the radar antenna 10 reaches the first angle (that is, every time the radar antenna 10 revolves once). As described above, because the output cycle of the target object data can be made the same as the updating cycle (the revolving cycle of the radar antenna 10), the target object data can be efficiently outputted without any delays.

As described above, the radar apparatus 1 of this embodiment includes the TT information acquiring module 14, the AIS information acquiring module 15, the priority determination module 22, and the output control module 23. The TT information acquiring module 14 acquires the target object data by performing the target tracking based on the echoes received by the radar antenna 10. The AIS information acquiring module 15 acquires the target object data based on the AIS. The priority determination module 22 performs the priority determination according to the predetermined rule for the target object data acquired by the TT information acquiring module 14 and the target object data acquired by the AIS information acquiring module 15. The output control module 23 outputs the target object data. Then, the output control module 23 outputs the target object data sequentially, starting from the target object data with the highest priority, until the rotation angle of the radar antenna 10 reaches the second predetermined angle from the first predetermined angle.

That is, in the radar apparatus for acquiring the target object data by the AIS and the TT, because the number of target object data increases, the data output tends to be delayed. In this regard, by configuring as described above, the target object data can be outputted at the revolving cycle of the radar antenna. In addition, the data output can be carried out while suppressing the delay, where the target object data acquired by the TT information acquiring module 14 and the target object data acquired by the AIS information acquiring module 15 are mixed together.

Although suitable embodiments and a modification according to the present invention are described above, the above configurations may be modified as follows, for example.

In the above embodiments, the output control module 23 limits the number of target object data outputted to the ECDIS 2 to the maximum number of output data. However, in fact, it is more preferred that the output control module 23 limits the number of target object data to 90% of the maximum number of output data, leaving about 10% margin, for example.

In the description of the above embodiments, the target object data is outputted using the communication sentence of the TTD. However, because the TTD is still a new communication sentence in the market, the external apparatus (ECDIS) side may not support the TTD. For this reason, it is preferred that the communication sentence at the time of outputting the target object data may be selectively switched between the TTD and the TTM which is an outdated communication sentence. The TTM (Tracked Target Message) is the communication sentence having a variable data length where one sentence is 82 bytes at the maximum. In addition, the TTM transmits the target object data by an ASCII code, and can transmit only one target object data per one sentence. If the external apparatus supports both the TTM and the TTD, the target object data may be outputted using the TTD where more target object data can be transmitted per one sentence.

The TT information acquiring module 14, the AIS information acquiring module 15, the external output module 17 and the like are configured as dedicated hardware. However, instead of the configuration, they may be configured with general-purpose hardware, such as a CPU, and software which runs on the CPU.

As the indices for determining the priority of the target object data, the distance from the target object, the speed of the target object, the CPA, TCPA, BCR, and BCT are described. However, the priority may be determined using indices other than the above. Thus, the priority may be determined not only by using a single index but also using a combination of two or more indices. That is, it is sufficient as long as the priorities can be determined for the target object data under a certain rule in order of the operator's interest levels.

The navigation assisting device of the above embodiments is applicable not only to the ship radar apparatus but also to any other navigation assisting devices provided with the reception function of the AIS and the TT function. Further, the target object data outputted from the navigation assisting device may be used not only with the ECDIS but also with various kinds of devices.

In the first embodiment, the maximum-number-of-output-data determination module calculates the maximum number of output data. However, the maximum number of output data may be determined by methods other than calculation. For example, a relation between the revolving cycle of the antenna and the communication rate, and the maximum number of output data may be stored in a table in advance. According to this configuration, the maximum-number-of-output-data determination module can determine the maximum number of output data only by referring to the table.

In the first embodiment, when outputting the target object data from the output control module 23 to the ECDIS, it does not necessarily output sequentially from the one with a higher priority. That is, in the first embodiment, because the target object data to be outputted during one revolution of the radar antenna has been determined when the sorting was finished, the target object data may be outputted in any order.

In the second embodiment, the first angle and the second angle may be identical. However, it is more preferred to temporarily stop the output of the target object data before one revolution of the radar antenna 10 is completed, leaving the certain amount of margin.

In the second embodiment, the output control module 23 does not necessarily directly detect the rotation angle of the radar antenna 10, and a substantial rotation angle of the radar antenna 10 may be obtained using any other methods. For example, a time from the rotation angle of the radar antenna reaching the first angle may be measured, and the reaching of the second angle may be determined when a predetermined time has lapsed.

In the foregoing specification, specific embodiments of the present invention have been described. However, one of ordinary skill in the technique appreciates that various modifications and changes can be performed without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the tendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the technique, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

What is claimed is:

1. A navigation assisting device, comprising:

a TT information acquiring module for acquiring target object data by performing target tracking based on an echo received by a radar antenna;

an AIS information acquiring module for acquiring target object data based on a Universal Shipborne Automatic Identification System;

a maximum-number-of-output-data determination module for determining a maximum number of output data that is the number of target object data that is outputable while the radar antenna revolves once;

a priority determination module for performing a priority determination according to a predetermined rule, for the target object data acquired by the TT information acquiring module and the target object data acquired by the AIS information acquiring module; and an output control module for outputting the target object data fewer than the maximum number of output data according to the priorities while the radar antenna revolves once.

2. The navigation assisting device of claim 1, wherein the maximum-number- of-output-data determination module measures a revolving speed of the radar antenna, and calculates the maximum number of output data based on the revolving speed.

3. The navigation assisting device of claim 2, wherein the target object data acquired by the TT information acquiring module is outputted with a higher priority.

4. The navigation assisting device of claim 2, wherein the priority determination module updates the priorities for every predetermined priority updating cycle.

5. The navigation assisting device of claim 1, wherein the target object data acquired by the TT information acquiring module is outputted with a higher priority.

6. The navigation assisting device of claim 5, wherein the priority determination module updates the priorities for every predetermined priority updating cycle.

7. The navigation assisting device of claim 1, wherein the priority determination module updates the priorities for every predetermined priority updating cycle.

8. The navigation assisting device of claim 7, wherein the priority updating cycle is longer than the revolving cycle of the radar antenna.

9. A navigation assisting device, comprising:

a TT information acquiring module for acquiring target object data by performing target tracking based on an echo received by a radar antenna;

an AIS information acquiring module for acquiring target object data based on a Universal Shipborne Automatic Identification System;

a priority determination module for performing a priority determination according to a predetermined rule, for the target object data acquired by the TT information acquiring module and the target object data acquired by the AIS information acquiring module; and an output control module for outputting the target object data;

wherein the output control module outputs the target object data sequentially from the target object data with the highest priority, until a rotation angle of the radar antenna reaches a second predetermined angle from a first predetermined angle.

10. The navigation assisting device of any one of claims 1 to 9, wherein the priority determination module calculates at least one index, for each of the target object data acquired by the TT information acquiring module and the target object acquired by the AIS information acquiring module, the index related to a distance to a target object corresponding to the target object data, a speed of the target object, CPA, TCPA, BCR and BCT, and performs the priority determination based on the index.

11. The navigation assisting device of claim 10, wherein the target object data acquired by the TT information acquiring module is outputted with a higher priority.

12. The navigation assisting device of claim 10, wherein the priority determination module updates the priorities for every predetermined priority updating cycle.

13. The navigation assisting device of claim 9, wherein the target object data acquired by the TT information acquiring module is outputted with a higher priority.

14. The navigation assisting device of claim 9, wherein the priority determination module updates the priorities for every predetermined priority updating cycle.

* * * * *